US005561279A

United States Patent [19]

Hattori et al.

[11] Patent Number: 5,561,279

[45] Date of Patent: Oct. 1, 1996

[54] MULTIPLE SWITCH ASSEMBLY INCLUDING OPERATING KNOB ARTICULATION PIECE

[75] Inventors: Yoshitaka Hattori; Minoru Nishio, both of Aichi, Japan

[73] Assignee: Kabushiki Kaisha Tokai Rika Denki Seisakusho, Aichi, Japan

[21] Appl. No.: 358,307

[22] Filed: Dec. 19, 1994

[30] Foreign Application Priority Data

Dec. 20, 1993 [JP] Japan ..... 5-067696

[51] Int. Cl.[6] ..... H01H 21/00

[52] U.S. Cl. ..... 200/6 R; 200/339

[58] Field of Search ..... 200/6 R, 315, 200/316, 318.2, 321, 325, 327, 339, 402, 453–467, 468–472, 553, 556, 557

[56] References Cited

U.S. PATENT DOCUMENTS

| | | | |
|---|---|---|---|
| 4,002,874 | 1/1977 | Brown | 200/321 |
| 4,045,650 | 8/1977 | Nestor | 200/339 X |
| 4,135,073 | 1/1979 | Kobayashi | 200/315 |
| 4,314,111 | 2/1982 | Kobayashi | 200/339 X |
| 4,340,791 | 7/1982 | Sorenson | 200/315 X |
| 4,947,008 | 8/1990 | Sato et al. | 200/6 R |
| 5,357,071 | 10/1994 | Hanaki | 200/557 |

*Primary Examiner*—J. R. Scott

*Attorney, Agent, or Firm*—Finnegan, Henderson, Farabow, Garrett & Dunner, L.L.P.

[57] ABSTRACT

A switch device includes a switch body, an operating knob rockingly provided on the switch body, an articulation surface provided in a rear surface the operating knob, an articulation piece provided on the switch body, the articulation piece being pushed against the articulation surface to urge the operating knob to be set at a neutral position, a pusher cooperating with the operating knob a switch operated by the pusher when the operating knob rocks, and a pin penetrating both side walls of the operating knob and extending through the pusher, the pin being provided inside the operating knob, the pin inserted into an elongated hole formed in said articulation piece to permit an articulating motion of the articulation piece.

2 Claims, 4 Drawing Sheets

"PRIOR ART"

FIG. 7 "PRIOR ART"

MULTIPLE SWITCH ASSEMBLY INCLUDING OPERATING KNOB ARTICULATION PIECE

BACKGROUND OF THE INVENTION

1. Field of the invention

This invention relates to a switch device which is suitable, for instance for an automobile's power window regulator 2. Related art A conventional switch device for an automobile's power window regulator, as shown in FIGS. 6 and 7, comprises a plastic switch body 1, and a plastic operating knob 13. The plastic switch body 1 includes a pair of supporting walls 2 and 2 on the right and left side of the switch body 1 as viewed in FIG. 7. The outer surfaces of the supporting walls 2 include a pair of protrusions 3 and 3 are formed, respectively. The plastic operating knob 13 is in the form of a cap extended in the front-to-rear direction of the switch device. The operating knob 13 includes right and left walls which have a pair of engaging holes 5 and 5, respectively. The operating knob 13 is rockingly coupled to the switch body 1 with the protrusions 3 engaged with the engaging holes 5°.

As shown in FIG. 7, an articulation surface 19 is formed in the rear surface of the operating knob 13. The switch body 1 further includes an accommodating portion 7 at the center which is in the form of a rectangular pipe section. An articulation piece 15 and a coil spring 28 are set in the accommodating portion 7 in such a manner that the articulation piece 15 is pushed against the articulation surface 19 by the elastic force of the coil spring 28. The operating knob 13 is coupled to a pusher (not shown), so that when the pusher is rocked, a window-opening switch and a window-closing switch are turned on and off.

The operating knob 13 is normally held at the neutral position by the cooperation of the articulation piece 15 and the articulation surface 19. When, under this condition, the operator depresses the left end portion of the operating knob 13 as viewed in FIG. 6, the operating knob 13 is turned about the protrusions 3 (in the engaging holes 5) in the direction of the arrow A, to turn on the window-opening (lowering) switch. When the operator releases the operating knob 13, the operating knob 13 is returned to the neutral position, and the switch is turned off. When the operator pulls the left end portion of the operating knob 13 upwardly by using a recess **4*a* formed in the operating knob 13, the operating knob 13** is turned in the direction of the arrow B, so that the window-closing (lifting) switch is turned on.

The conventional switch device suffers from the following difficulty: The operating knob 13 is rockingly coupled to the switch body 1 with the protrusions 3 engaged with the engaging holes 5. Hence, if the operating knob 13 is operated with an excessively great force, then it may readily come off the switch body 1, especially when the operating knob 13 is pulled upwardly.

SUMMARY OF THE INVENTION

In view of the foregoing, an object of this invention is to provide a switch device in which an operating knob is rockingly and positively coupled to a switch body, thus preventing the operating knob from coming off the switch body.

The foregoing object of the invention has been achieved by the provision of a switch device comprising: a switch body; an operating knob having a rear surface and side walls which is rockingly provided on the switch body; an articulation surface provided in the rear surface of the operating knob; an articulation piece which is provided on the switch body, the articulation piece being pushed against the articulation surface, to urge the operating knob to be set at a neutral position; and a switch which is operated by the rocking of the operating knob, wherein the operating knob is rockingly coupled to the switch body through a pin which penetrates both side walls of the operating knob, the pin being provided inside the operating knob, and inserted into an elongated hole formed in the articulation piece in such a manner as to permit an articulating motion of the articulation piece.

In the switch device of the invention, the operating knob is rockingly mounted on the switch body through the pin penetrating the side walls of the operating knob. In contrast to the conventional switch device in which the operating knob is coupled to the switch body with the protrusions engaged with the engaging holes, the present invention provides for an operating knob which is positively coupled to the switch body, so that the operating knob will never become detached from the switch body even when pushed with a great force.

The articulation surface for urging the operating knob to the neutral position should be provided such that they would not interfere with the pin. However, in order to position them so as not to interfere the pin, it should be necessary to increase the size of the switch body.

This difficulty is eliminated by the present invention since the pin is inserted into the elongated hole formed in the articulation piece permitting the articulating motion of the articulation piece. Such a configuration makes it unnecessary to position the articulation piece away from away from the pin and accordingly to increase the size of the switch body.

BRIEF DESCRIPTION OF THE DRAWINGS

FIG. 7 is a vertical sectional view of the conventional switch device.

DETAILED DESCRIPTION OF THE PREFERRED EMBODIMENTS

A switch device for an automobile's power window regulator will be described with reference to FIGS. 1 through 5, which constitutes one preferred embodiment of the invention.

Figure 5:
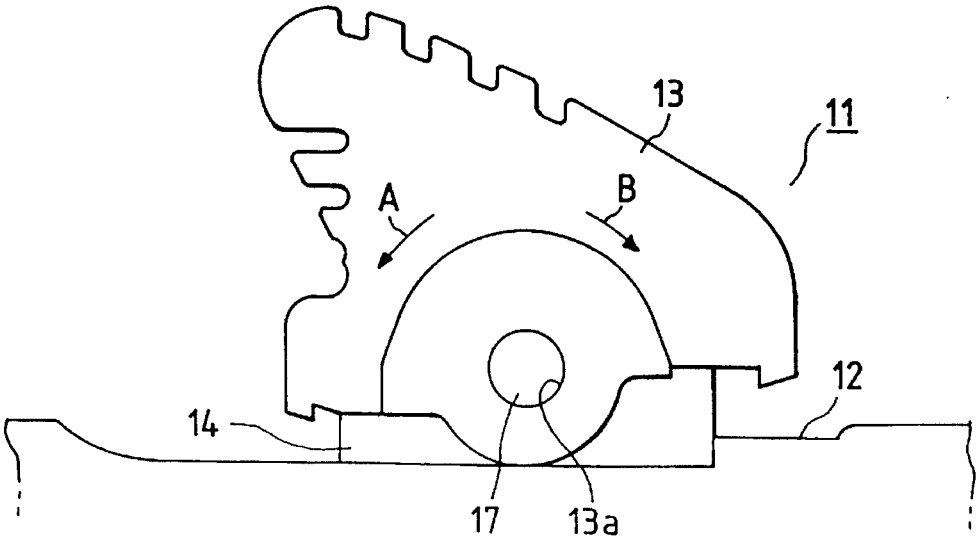
FIG. 5 is a side view of the switch device of the present invention.
Figure 6:
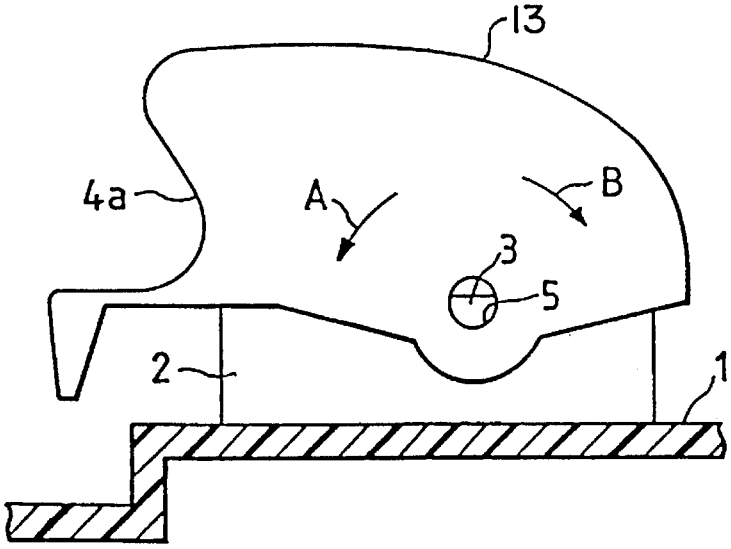
FIG. 6 is a side view of a conventional switch device, corresponding to FIG. 5.
Figure 6:
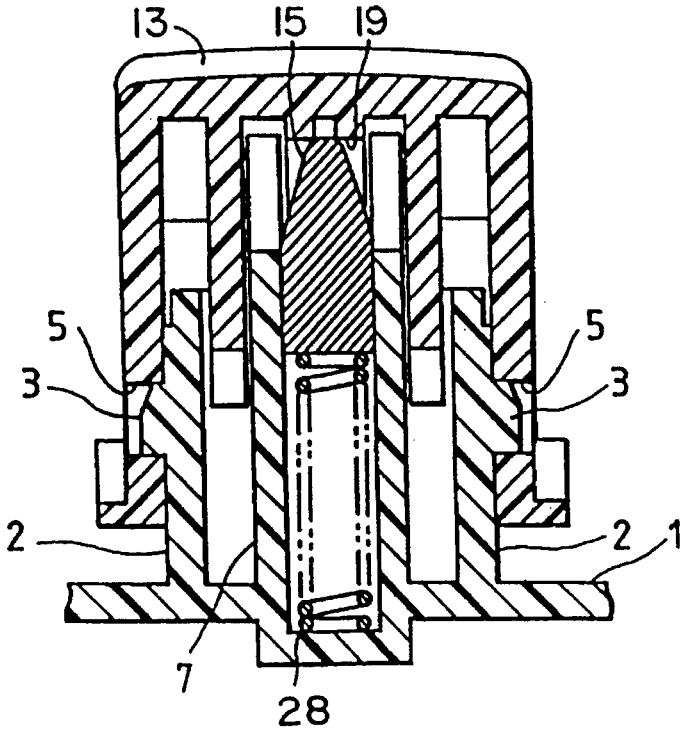

FIG. 5 is a side view showing an external appearance of the switch device 11 according to the invention. The switch device 11 comprises a plastic switch body 12, and a plastic operating knob 13 which is rockingly mounted on the switch body 12. In a power window operating (opening and closing) switch unit (not shown), the switch body 12 is in the form of a rectangular box, and four switch devices 11 (or, operating knobs 13) are provided on the four sides of the switch body 12, respectively.

As shown in FIGS. 1 through 4, the switch body 12 includes a mounting pipe 14, substantially rectangular in section, which is integral with the switch body 12 and is extended upwardly from the upper surface of the switch body 12.

Figure 1:
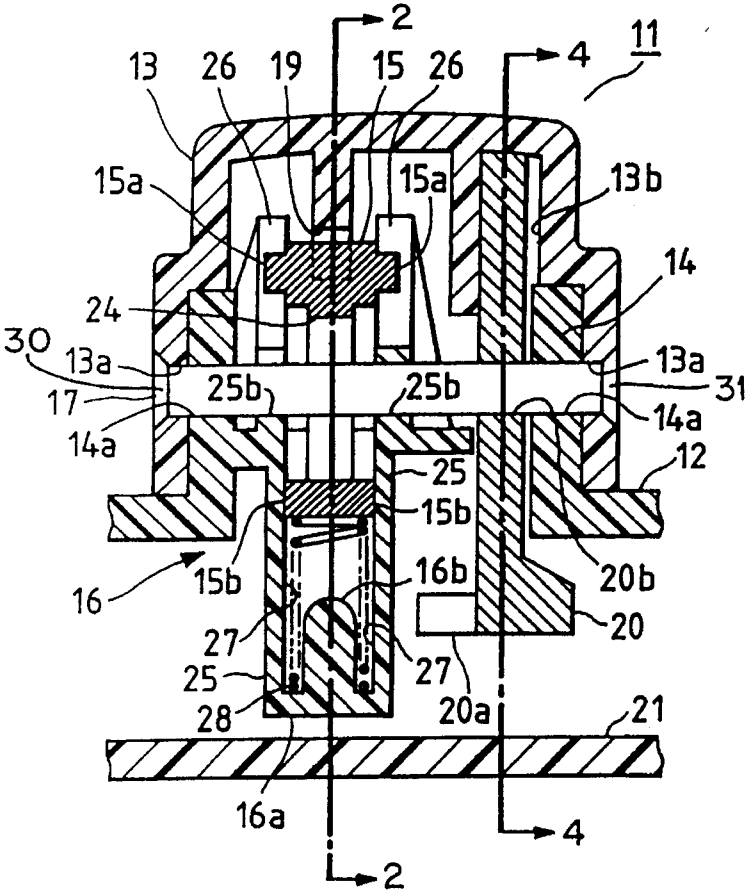
FIG. 1 is a vertical sectional view of a switch device, which constitutes embodiment of the invention.

The mounting pipe 14 has right and left walls whose upper end portions are semi-circular, and have mounting holes 14*a* at their centers, respectively, as shown in FIG. 1. The switch body 12 further includes an accommodating chamber 16 inside the mounting pipe 14 which is adapted to accommodate an articulation piece 15 (described later). More specifically, the accommodating chamber 16 is located in the left half of the inside of the mounting pipe 14 as viewed in FIG. 1.

Figure 2:
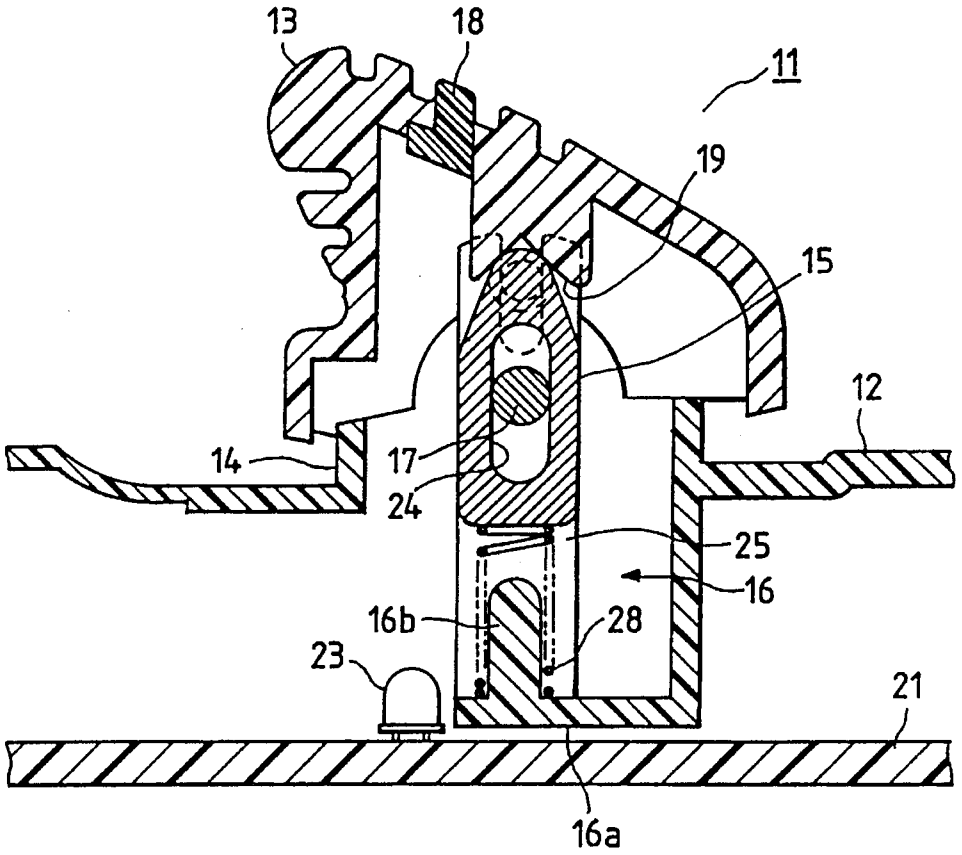
FIG. 2 is a vertical sectional view taken along line 2—2 in FIG. 1.
Figure 3:
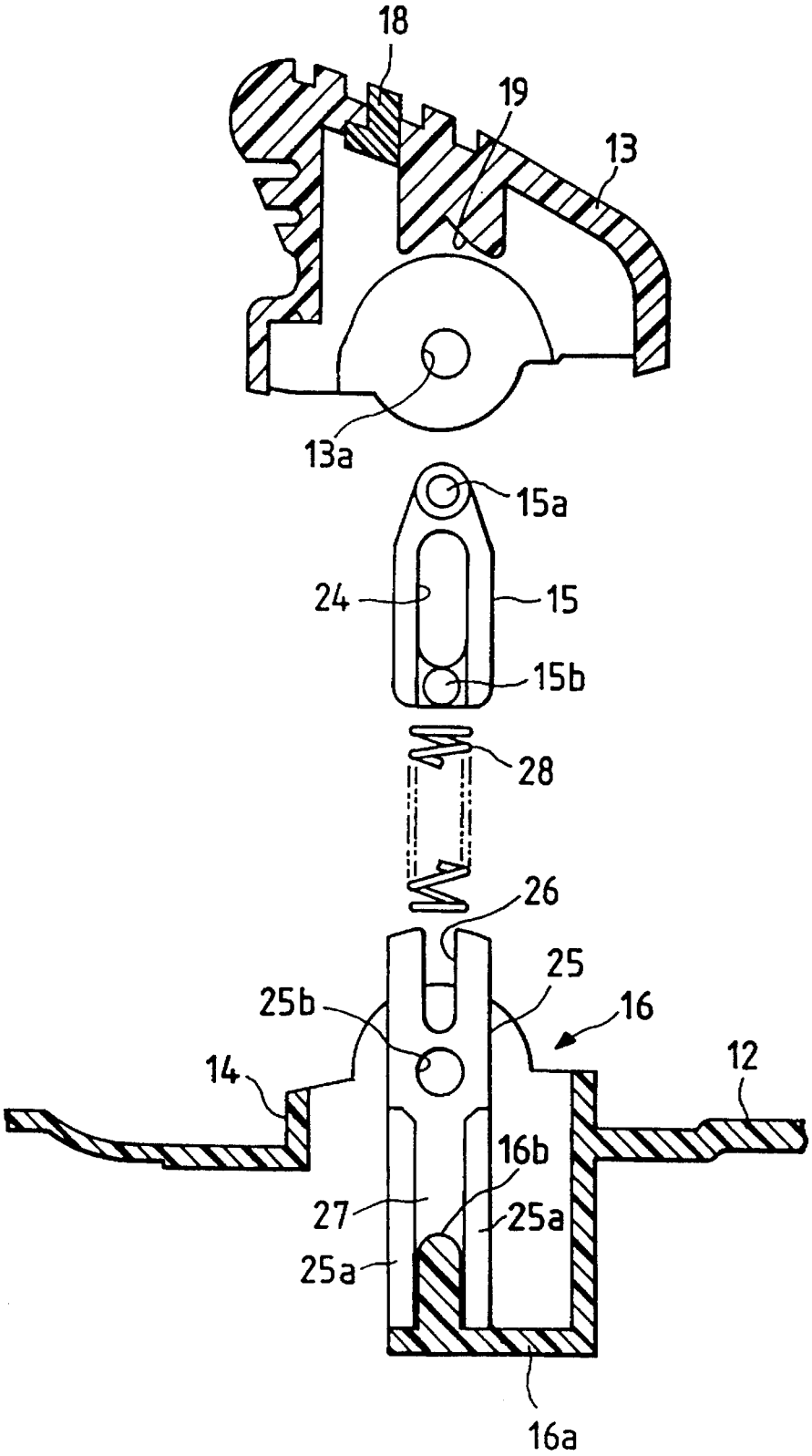
FIG. 3 is an exploded view, partly as a sectional view, showing essential components of the switch device.
Figure 4:
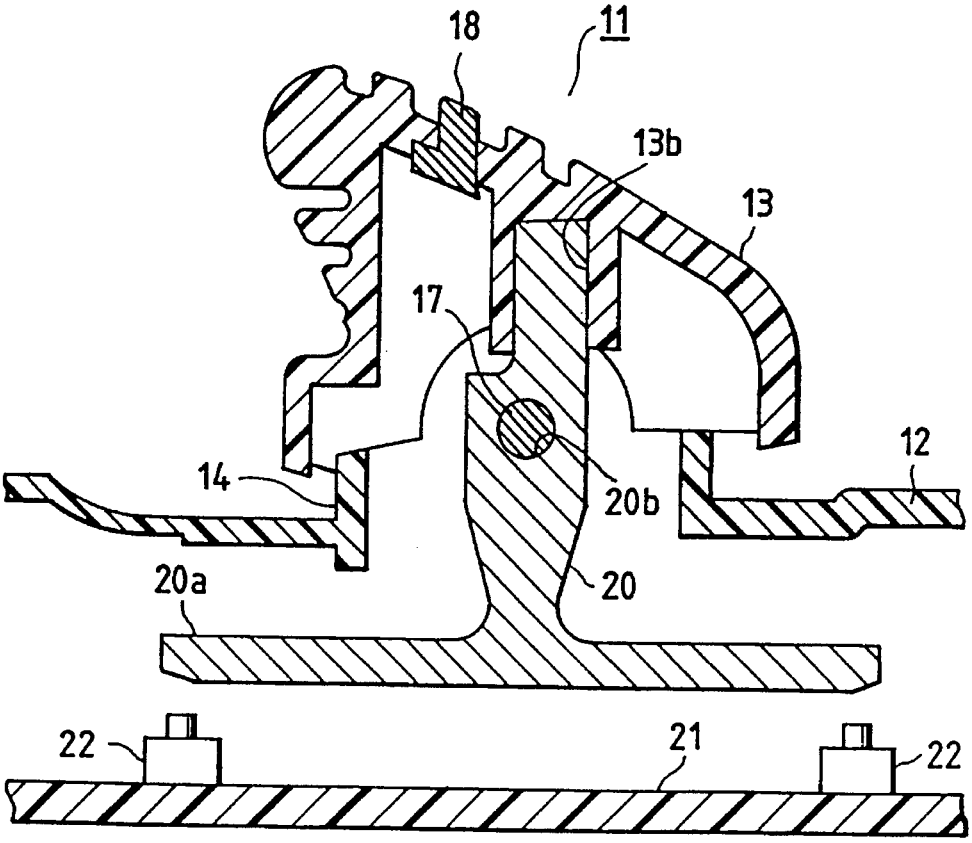
FIG. 4 is also a vertical sectional view taken along line 4—4 in FIG. 1.

As shown in FIGS. 2 through 5, the operating knob 13 is in the form of a cap which is, sloped upwardly to the left in and opened downwardly. As shown in FIG. 1, the operating knob 13 has right and left walls which are engaged with the outer surfaces of the right and left walls of the mounting pipe 14, and have mounting holes 13*a* and 13*a* which are set in alignment with the mounting holes 14*a* of the mounting pipe 14. The operating knob 13 is rockingly mounted on the mounting pipe 14 with a pin 17 (described later in detail). As shown in FIGS. 2 through 4, a shining part 18 is fitted in the upper surface of the operating knob 13 by using transparent resin which shines when a light is turned on at night. A plurality of grooves are formed in the upper surface and the left side surface of the operating knob 13 as viewed in FIG. 1, to prevent the slip of the finger when the operating knob is operated.

The operating knob 13 includes an articulation surface 19 in the left half of the inner surface of the upper wall of the operating knob 13 as viewed in FIG. 1. As shown in FIGS. 2 and 3, the articulation surface 19 is a gently inverted V-shaped in side view. The articulation piece 15 is abutted against the inverted-V-shaped articulation surface 19 from below. As the upper end of the articulation piece 15 is engaged with the bottom of the inverted-V-shaped articulation surface 19, the operating knob 13 is urged to be set at the neutral position. The operating knob 13 has an engaging space in its right end portion as viewed in FIG. 1 into which a pusher 20 is inserted.

The pusher 20, as shown in FIG. 4, is substantially inverted-T-shaped. The pusher 20 is coupled to the operating knob 13 by press-fitting the upper end portion of its vertical portion in the engaging space 13*b* of the operating knob 13. The horizontal portion of the pusher 20, namely, an operating portion 20*a*, is positioned inside the switch body 12 and above a substrate 21. The operating portion 20*a* is made of an elastic material. The pusher 20 has a circular through-hole 20*b* in the vertical portion substantially at the middle.

As shown in FIG. 4, power window motor driving tactile switches 22 and 22 are provided on the substrate 21 so that they are operated by both ends of the operation portion 20*a* of the pusher 20. When the operating knob 13 is rocked, the pusher 20 is swung about a pin 17 fitted in the through-holes 20*b* to turn on one of the tactile switches 22. An LED (light emitting diode) 23 is provided on the substrate 21 to cause the shining part 18 to illuminate (see FIG. 2).

The articulation piece 15 and the accommodating chamber 16 will be described in more detail.

As shown in FIGS. 2 and 3, the articulation piece 15 is vertically long, and its upper end portion is tapered and rounded. The articulation piece 15, as shown in FIG. 1, has engaging protrusions 15*a* and 15*b* respectively at the upper and lower ends which are integral with the articulation piece 15 and extended to the right and the left. More specifically, the upper engaging protrusions 15*a* are extended to the right and left more than the lower engaging protrusion 15*b*. Furthermore, the articulation piece 15 has a hole 24 in the middle which is vertically elongated.

The accommodating chamber 16 integral with the switch body 12 is made up of a bottom wall 16*a* located immediately above the aforementioned substrate 21, and a pair of right and left guide walls 25 and 25 which are extended upwardly from the bottom wall 16*a* so as to embrace the articulation piece 15 from both sides (right and left). As shown in FIG. 3, the guide walls 25 and 25 are extended upwardly from the bottom wall 16*a*, and their upper ends are located slightly above the upper end of the mounting pipe 14.

Each of the guide walls 25 has a groove 26 cut in the upper end portion which is opened upwardly and extends downwardly along the central axis. Furthermore, each of the guide walls 25 includes a pair of protruded walls 25*a* and 25*a* formed on the inner surface of its lower half which are extended along the right and left edges thereof. The protruded walls 25*a* thus formed define a guide recess 27 which is extended vertically and opened upwardly. Each of the guide walls 25 has a circular through-hole 25*b* in the middle portion. The through-holes 25*b* of the guide walls 25 are positioned so that they are in alignment with the mounting holes 14*a* formed in the mounting pipe 14. A protrusion 16*b* is formed on the bottom wall 16*a* of the accommodating chamber 16 and between the pair of guide walls 25 and 25.

With the lower end portion of a coil spring 28 loosely mounted on the protrusion 16*b*, the articulation piece 15 is inserted in between the guide walls 25 and 25 from above. In this operation, as shown in FIG. 1, the outer ends of the lower engaging protrusions 15*b* of the articulation piece are positioned in the guide recesses 27, respectively, while the outer ends of the upper engaging protrusions 15*a* are positioned in the grooves 26 of the guide walls 25, respectively. As a result, the articulation piece 15 is urged upwardly by the coil spring 28; more specifically, the articulation piece 15 thus supported is movable only vertically while being guided by the guide walls 25.

The operating knob 13 is rockingly coupled to the mounting pipe 14 of the switch body 12 through a round-rodshaped pin 17 which penetrates the operating knob 13 horizontally. The operating knob 13 is coupled to the mounting pipe 14 of the switch body 12 as follows: First, the coil spring 28 and the articulation piece 15 are set in the accommodating chamber 16 of the switch body in the above-described manner. Under this condition, the operating knob 13 is temporarily engaged with the mounting pipe 14, and the pusher 20 is fitted in the engaging space 13*b* of the operating knob 13 from below.

The mounting holes 13*a* and 13*a* of the operating knob 13, the mounting holes 14*a* and 14*a* of the mounting pipe 14, the through-hole 20*b* of the pusher 20, the through-holes 25*b* and 25*b* of the guide walls 25 and 25, and the elongated hole 24 of the articulation piece 15 are arranged horizontally, in one straight line. The pin 17 having a stopper 31 at its base end is inserted into those holes from either side of the operating knob 13 from right or left until the other end portion of the pin 17 appears outside. A retaining member such as an E-ring 30 is engaged with the other end portion of the pin 17, so that the latter 17 is prevented from coming off the operating knob 13. Thus, the operating knob 13, has been coupled to the switch body 12.

Now, the operating knob 13 is rockable about the pin 17 in the direction of the arrow A and in the direction of the arrow B as shown in FIG. 5. The range of rock of the operating knob 13 is limited by the front and rear ends of the lower end face of the operating knob 13 which are brought into contact with the upper surface of the switch body 12. In this connection, the vertical movement of the articulation piece 15 is not obstructed by the pin 17, because the pin 17 is inserted into the elongated hole 24 of the articulation piece 15.

The operation of the switch device thus constructed will be described.

When the switch device is not in operation, i.e, when no operating force is applied to the operating knob 13, the operating knob 13 is held set at the neutral position by the cooperation of the articulation piece 15 and the articulation surface 19. In this case, as shown in FIG. 4, the operating portion 20*a* of the pusher 20 is spaced apart from the switches 22; that is, the switches 22 are kept turned off.

When, under this condition, the operator depresses the operating knob 13, the operating knob 13 is rocked in the direction of the arrow A in FIG. 5, and accordingly the pusher 20 is turned together with the operating knob 13 to turn on one of the switches 22 (i.e., the left switch 22 in FIG. 4) so that the window opening (lowering) operation is started. At the same time, the articulation piece 15 is pushed downwardly against the elastic force of the coil spring 28 by the slope of the articulation surface 19, so that the articulation piece 15 is displaced downwardly.

When, under this condition, the operator releases the operating knob 13, the articulation piece 15 is displaced upwardly while pushing the slope of the articulation surface 19 upwardly. As the end of the articulation piece 15 goes into the bottom of the inverted-V-shaped articulation surface 19, the operating knob 13 is rocked back to be set at the neutral position. At the same time, the switch is turned off, and the window is stopped. As was described before, the pin 17 penetrates the articulation piece 15; however, the vertical displacement of the articulation piece 15; i.e., the articulating motion of the latter is permitted, because the pin 17 penetrates the articulation piece 15 through the vertically elongated hole 24 formed in the articulation piece 15.

When the operator pulls the operating knob 13 upwardly from the neutral position, the operating knob 13 is rocked in the direction of the arrow B in FIG. 5. As a result, the pusher 20 turns on the other switch (the right switch in FIG. 4), so that the window closing (lifting) operation is started. Similarly as in the above-described case, when the operator releases the operating knob 13, the operating knob 13 is rocked back by the cooperation of the articulation surface 19 and the articulation piece 15, so that the operating knob is set at the neutral position again, and the switch 22 is turned off.

In general, the operation of pulling the operating knob 13 upwardly requires a greater force than the operation of pushing the operating knob downwardly, and accordingly an excessively great force is applied to the supporting points of the operating knob 13; i.e., to the mounting holes 13*a* of the operating knob 13. In this connection, it should be noted that, in the switch device of the invention, the operating knob 13 is coupled to the switch body 12 through the pin 17. Hence, the operating knob 13 is more positively coupled to the switch body than in the conventional switch device in which the protrusions of the switch body are engaged with the holes formed in the operating knob; that is, the switch device is free from the difficulties that the operating knob 13 comes off the switch body 12 or is deformed or damaged during operation.

It is true that the operating knob 13 is positively coupled to the switch body 1 with the pin 17 penetrated through the switch body 1 and the operating knob 13 in the above-described manner. However, in this case, the components inside the operating knob must be arranged so as not to interfere with the pin 17; that is, the arrangement of those components has a low degree of freedom. If the articulation piece 15 and the articulation surface 19 are arranged above or below the pin 17, then it is necessary to increase the size of the switch body 12 or the operating knob 13.

On the other hand, in the switch device of the invention, the pin 17 is inserted into the elongated hole formed in the articulation piece 15. Hence, the articulating motion of the articulation piece 15 is not obstructed at all, and it is unnecessary to position the articulation piece 15 away from the pin 17 and accordingly to increase the size of the switch body 12 or the operating knob 13.

In the embodiment of the invention, the accommodating chamber 16 for accommodating the articulation piece 15 is made up of the pair of guide walls 25 and 25, which contributes to the reduction in installation space of the accommodating chamber 16. Accordingly, the space is increased as much in which the output light of the LED 23 is led to the shining part 18; that is, the latter 18 is allowed to shine illuminate brightly. This is one of the advantages of the embodiment. Furthermore, the pin 17 is inserted into the through-hole 2O*b* formed in the pusher 20; that is, the pusher 20 is supported not only by the operating knob 13 but also by the pin. Hence, it is not necessary to fixedly secure the pusher 20 to the operating knob 13. This is another advantage of the embodiment.

As was described above, in the embodiment of the invention, the operating knob 13 is rockingly mounted on the switch body 12 through the pin 17. In the conventional switch device, the operating knob 13 is liable to readily come off the switch body 1, because the operating knob 13 is coupled to the switch body 1 by engaging the protrusions 3 with the engaging holes 5. In the present invention, the operating knob 13 is positively coupled to the switch body 13, so that the operating knob 13 will not come off the switch body 12 even when pushed greatly. In addition, as was described above, in the embodiment of the invention, the pin 17 is inserted into the elongated hole 24 formed in the articulation piece 15, which makes it unnecessary to increase the size of the switch body 12 or the operating knob 13.

While the invention has been described with reference 5 to the preferred embodiment, it should be noted that the invention is not limited thereto or thereby. For instance, the technical concept of the invention may be applied not only to a switch device for an automobile's power window regulator but also to other switch devices different in use. That is, the above-described embodiment may be changed or modified in various manners without departing from the invention.

As was described above, in the switch device comprising the switch body and the operating knob rockingly mounted on the latter; the operating knob is rockingly coupled to the switch body through the pin which is provided inside the operating knob and penetrates both side walls of the operating knob in such a manner that it is inserted into an elongated hole formed in the articulation piece permitting the articulating motion of the articulation piece. Hence, in the switch device, the operating knob is positively coupled to the switch body, so that the operating knob will never come off the switch body even when pushed with great force. In addition, this structure makes it unnecessary to increase the size of the switch device. Those effects should be highly appreciated in practical use.

What is claimed is:

1. A switch device comprising:

a switch body including a pair of guide walls having grooves;

an operating knob pivotally provided on said switch body, said operating knob having a pair of side walls and a top wall connected between said side walls, said top wall defining an articulation surface;

an articulation piece having engaging protrusions on opposite sides and an elongated slot, said engaging protrusions slideably supporting said articulation piece in said grooves of said guide walls of said switch body, and whereby said articulation piece and said articulation surface of said top wall constitute detent means such that said articulation piece is urged against said articulation surface of said top wall to provide a force to bias said operating knob to a centered non-operational position;

a pin extending through said side walls of said operating knob, said guide walls of said switch body, and said elongated slot of said articulation piece, wherein said articulation piece is slidably supported by said elongated slot on said pin such that when a force is applied to said operating knob, said articulation piece slides downwardly on said pin, and said operating knob pivots on said pin relative to said articulation piece;

a pusher cooperating with said operating knob; and a pair of switches operated by said pusher when said operating knob pivots.

2. A switch device as claimed in claim 1, wherein said pusher includes first and second arms, said first arm having a through hole in which said pin extends, wherein said pusher is pivoted about said pin when said operating knob is pivoted in response to said force applied to said operating knob, and said pusher is pivoted until said second arm engages one of said switches.

* * * * *